United States Patent [19]

Teshima et al.

[11] 4,226,929

[45] Oct. 7, 1980

[54] FLEXIBLE MULTI-LAYER PHOTORECEPTOR OF ELECTROPHOTOGRAPHY

[75] Inventors: Toru Teshima, Yokohama; Hiroshi Nozaki, Chiba; Minoru Koyama, Tokyo; Kazuhisa Katoh, Yokohama, all of Japan

[73] Assignee: Stanley Electric Co., Ltd., Tokyo, Japan

[21] Appl. No.: 958,493

[22] Filed: Nov. 7, 1978

[30] Foreign Application Priority Data

Nov. 15, 1977 [JP] Japan ..... 52-136261

[51] Int. Cl.[3] ..... G03G 5/082; G03G 5/09

[52] U.S. Cl. ..... 430/57; 430/85; 430/86; 430/95

[58] Field of Search ..... 96/1.5 R; 252/501; 430/85, 86, 57, 95

[56] References Cited

U.S. PATENT DOCUMENTS 3,655,377 4/1972 Sechak ..... 96/1.5 R

FOREIGN PATENT DOCUMENTS 2109251 9/1972 Fed. Rep. of Germany ..... 96/1.5 R 2133064 1/1973 Fed. Rep. of Germany ..... 96/1.5 R

*Primary Examiner*—Roland E. Martin, Jr.

*Attorney, Agent, or Firm*—Cushman, Darby & Cushman

[57] ABSTRACT

A photoreceptor of electrophotography having a flexibility and a sensitivity to electromagnetic wavelengths of a wide range extending as far as the red color region of the spectrum of light rays is produced by forming a layer of a halogen-doped Se-S alloy on a substrate and further forming on said layer a halogen-doped Se-Te alloy layer. The Se-S alloy contains sulfur in a weight ratio of 0.1 to 0.35 to the Se-S alloy. The Se-Te alloy contains tellurium in a weight ratio of 0.05 to 0.35 to the Se-Te alloy.

6 Claims, 6 Drawing Figures

RESIDUAL POTENTIAL (V)
100
90
80
70
60
50
40
30
20
10
20
21
0
10
20
30
40
50
NUMBER OF REPETITION

SURFACE POTENTIAL (V)
1400
1200
1000
800
600
400
200
CHARGE
DARK DECAY
PHOTO-DECAY
0
10
20
30
40
50
TIME (sec.)

FLEXIBLE MULTI-LAYER PHOTORECEPTOR OF ELECTROPHOTOGRAPHY

BACKGROUND OF THE INVENTION (a) Field of the Invention:

The present invention relates to an electrophotography, and more particularly it pertains to a multi-layer photoconductive structure having a flexibility and a sensitivity to a light ray spectrum including red color.

(b) Description of the Prior Art:

In the art of electrophotography, a photoconductivelayer-containing plate is first given a uniform electrostatic charge by, for example, moving the plate between two corona-discharging devices in darkness. The resulting sensitized plate is exposed to light rays through a positive or negative transparency which is to be reproduced, so that the electric charges on those areas of the photoconductive layer exposed to light rays are caused to dissipate, leaving behind a latent electrostatic image in the areas of said layer not illuminated. This latent electrostatic image may be developed by depositing, onto the resulting surface of the photoconductive layer, a toner which is composed of finely pulverized particles of a mixture of a resin and black carbon powder to produce a visible image. This visible image may then be transferred onto a surface of a sheet of paper, and the resulting image-bearing sheet is heated to melt and solidify the resin. In this way, a more or less permanent image can be obtained. This concept of electrophotography was originally proposed by C. F. Carlson.

As an alternative method, the step of transferring the visible image onto a surface of a sheet of paper may be omitted by using, instead of the above-mentioned plate, a sheet of paper or other appropriate supporting sheet coated, on its surface, with a photoconductive material. This sheet itself serves as a copying sheet, and a visible image is produced directly on this sheet. This technique is known as "electro-fax".

The photoconductive-layer-carrying plate used in Carlson's method is required to possess the following principal properties. They are:

1. a high electric resistivity in darkness, and 2. a sufficient dissipation of this resistivity when exposed to light rays. These properties may be explained in more concrete terms as follows. Basically speaking, the plate is required to have a capability of being electrically charged up quickly up to a great amount of charge and to be capable of sufficiently retaining the charged electricity in darkness; and furthermore, the charged plate has to be capable of quickly dissipating the charged electricity down to a sufficiently low level of potential by its exposure to light rays, and the plate needs to have a good sensitivity to a wide range of spectrum of light rays. The electrophotographic plate for actual use on a copying machine which is designed to make copies repeatedly is required to have additional properties such as a high resistance to fatigue caused by the repetition of exposure to light rays as well as by the repetition of electrical charging, a high mechanical strength, a great deal of stability against ambient conditions, innocuousness for the body of the human being who handles the plate, easy to manufacture at low cost, and like requirements. It is often the case that these additional properties become important. From the foregoing viewpoints, photoconductive materials such as Se, ZnO, CdS and Polyvinyl-Carbazole (PVCz) have been heretofore put to practical use as a predominant component of the photoconductive layer. So long as the discussion on the non-mechanical printing technique is limited to Carlson's method among all those known techniques, however, a photoconductive layer consisting predominantly of Se may be safely said as being the best. However, even such Se-based photoconductive layer has still much to be improved with respect to electrostatic and mechanical properties, and efforts are being made to develop a new method of producing improved photoconductive materials to obtain an electrophotographic plate having improved electrostatic and mechanical properties.

Generally, amorphous selenium is employed for the production of a photoconductive layer containing selenium, because amorphous selenium has a higher resistivity in darkness and has an enhanced ability to retain charged electricity than does crystal selenium. However, amorphous selenium has a sensitivity to only a limited short wavelength portion of the electromagnetic spectrum and, therefore, it is not suitable for the reproduction of colored originals. In order to alleviate this disadvantage, a composite comprising finely pulverized crystal selenium dispersed in a matrix of amorphous selenium has been employed instead of amorphous selenium alone for the manufacture of a photoconductive layer so as to impart to the layer the good sensitivity of the crystal selenium to longer wavelengths of light rays. Notwithstanding such effort, the sensitivity of the resulting composite has been found to be still unsatisfactory because of essential lack of the sensitivity to that portion of electromagnetic spectrum around 6200Å. Moreover, amorphous selenium is unstable in its morphology and has a tendency to transform into a more stable form as crystal selenium. As stated above, selenium, in its crystal form, has a low resistivity and does not retain charged electricity for a sufficient length of time. On the other hand, amorphous selenium is frangible and lacks flexibility, so that a layer thereof coated on a substrate tends to come off from the substrate and to fracture from a slight bending. Thus, amorphous selenium has the disadvantage that the available configuration of the electrophotographic plate containing the amorphous selenium photoconductive layer is limited. In addition, there is an increasing demand for a higher speed printing. To meet this demand, there is needed the provision of an electrophotographic plate which has a much higher sensitivity over a wide range of wavelengths in the electromagnetic spectrum and which can respond at a higher speed to charge-up and exposure operations. A number of proposals have been made to increase the speed of response and to make selenium material sensitive up to longer wavelengths of the spectrum by doping the selenium material with an impurity. One of known such methods employs doping of tellurium (Te). Other than this, Japanese Patent Publication No. 42-13233 discloses the use of appropriate amounts of As and I as dopants, Japanese Patent Publication No. 44-12670 showns the employment of halogens, Japanese Publication No. 44-23556 discloses the employment of As, Br, and Cl, Japanese Publication No. 46-15478 discloses the employment of Sb and Japanese Publication No. 46-42679 discloses the employment of Sb-As, in appropriate amount, respectively. However, these methods are invariably more or less unsatisfactory. For example, "As" is toxic and must be handled with great care during the process of manufacture. Therefore, the inclusion of As in selenium material is not desirable. The experiments conducted by the inventors show that the addition of halogen leads to limiting the sensitivity of selenium to regions of shorter electromagnetic wavelengths. Thus, the halogen-doped selenium has hardly any sensitivity to red color, and moreover, it has little flexibility. Therefore, the photoconductive layer formed with halogen-doped selenium is practically without the advantage which selenium alone possesses. Antimony (Sb) has a marked tendency to segregate in a source melt during an ordinary vacuum evaporation-deposition process, making it difficult and unpractical to produce a uniform distribution of antimony at a desired concentration thereof throughout the photoconductive layer. At any rate, the above dopants have been employed usually to form a photoconductive layer on a substrate which is in the form of a plate or a cylindrical drum, because selenium lacks flexibility. An attempt to impart flexibility to selenium by doping it with sulfur (S) has been proposed in Japanese Patent Publication No. 43-29431. According to the results of the experiments conducted by the inventors, it has been found that as the concentration of sulfur in selenium material is elevated, the material becomes more flexible, but its response to optical exposure becomes slow. Besides, the wavelength range of spectrum to which the material is sensitive becomes limited to wavelengths shorter than the wavelengths to which the amorphous selenium having, dispersed therein, fine particles of crystal selenium is sensitive. Thus, it has been found that the sulfur-doped selenium material not only has no sensitivity to red color, but also exhibits a very high residual potential, and that in particular it has a very poor durability against repetition of a printing cycle. The slow response to optical exposure may be permissible in such a case wherein a high speed reproduction or copying is not required. However, an electrophotographic plate having a high residual potential gives rise to the formation of background which is so-called "fog" or "blurring" and brings about a poor contrast in the copy reproduced. Therefore, the sulfur-doped selenium material is not practical. The fact that such material is not sensitive at all to red color in the spectrum and the fact that the wavelengths to which it is sensiting become shorter with an elevation of the doping density of sulfur may be demonstrated also from the aspect of transmissivity of light rays exhibited by the material having a sulfur concentration as will be described in detail layer. As other techniques not using a dopant, Japanese Patent Publication No. 49-6228 discloses a method wherein selenium (Se) and arsenic (As) are dispersed in a solution of chlorinated rubber, and this dispersion is melted and quenched. Similarly, Japanese Patent Publication No. 50-10733 discloses to the art that red hexagonal selenium pigment is dispersed in a binder, and the dispersion is melted and quenched. Japanese Patent Publication No. 50-34414 discloses to the art that powdery selenium is dispersed in phthalocyanine, and the dispersion is melted and quenched. These mixtures shown in the above-mentioned known methods invariably have inferior properties as compared to those of amophous selenium. The composite material comprising selenium pigment dispersed in the binder has a poor resistance to solvent and, hence, there is the necessity for careful selection of a wet developer. As discussed above, the prior techniques are in general more or less unsatisfactory, and thus there has been a need for an improved photoconductive material or structure having desirable electrostatic and mechanical properties.

SUMMARY OF THE INVENTION

A primary object of the present invention is to provide a multi-layer photoreceptor of electrophotography having superior optical sensitivity, electrostatic property and other physical properties as compared to those of selenium by relying on an ordinary vacuum evaporation-deposition method.

Another object of the present invention is to provide a novel multi-layer photoconductive structure for use in a photoreceptor of electrophotography described above, which is more flexible than selenium and has a resistance to solvent, permitting the application thereto of a wet developer.

These objects as well as the features and the advantages of the present invention will become apprent by reading the following detailed description of the present invention when taken in conjunction with the accompanying drawings.

DETAILED DESCRIPTION OF THE PREFERRED EMBODIMENTS

It has been found by the inventors that the aforementioned objects can be achieved by the provision of a multi-layer photoconductive structure which is produced by forming a layer of an Se-S-Halogen mixture on a substrate and then forming a lyer of an Se-Te-Halogen mixture on top of said Se-S-Halogen layer.

Figure 1:
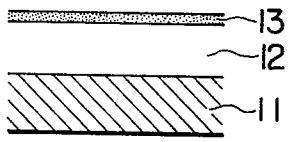
FIG. 1 is a diagrammatic cross sectional view of an embodiment of a multi-layer potoreceptor of electrophotography accordingto the present invention.
Figure 2:
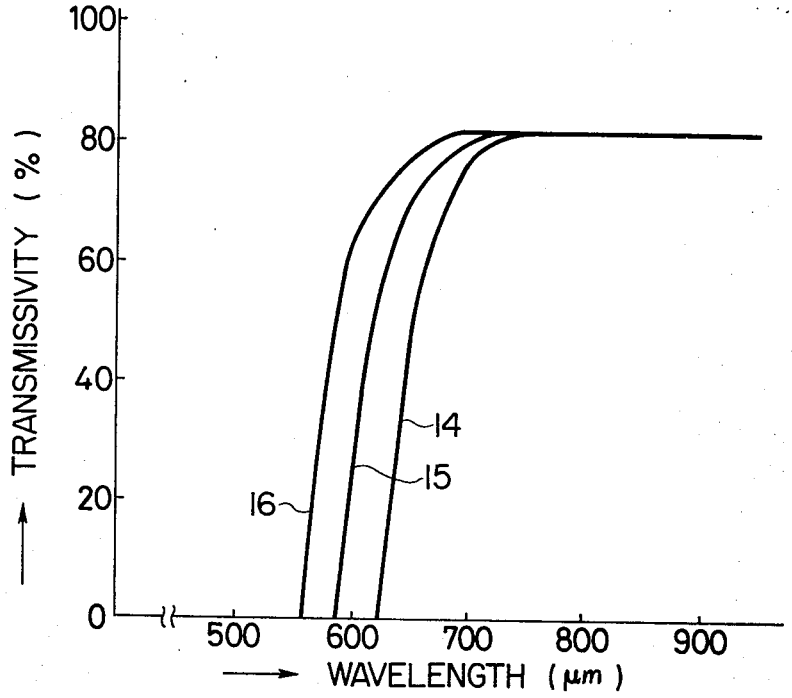
FIG. 2 is a chart showing electromagnetic wavelengths absorbed by a sulfur-doped selenium photoconductive layer varying with the amount of sulfur employed.

FIG. 1 shows a diagrammatic cross sectional view of a novel photoreceptor of electrophotography according to the present invention. In FIG. 1, reference numeral 11 represents an electroconductive substrate. 12 represents a photoconductive layer of an Se-S-Halogen mixture which is formed on said electroconductive substrate 11. Reference numeral 13 represents a photoconductive layer of an Se-Te-Halogen mixture which is formed on top of the photoconductive Se-S-Halogen layer 12. As pointed out previously, a photoreceptor of for electrophotography having a photoconductive layer of a sulfur-andselenium mixture has no sensitivity to red color, though it has an increased flexibility. Moreover, this receptor has the property that the electromagnetic wavelength to which such layer is sensitive becomes shorter with an increase in the sulfur content. This fact is clearly seen from FIG. 2. Curve 14 shows profile of transmissivity vs. wavelength of a vacuum-deposition film of 5 micrometers in thickness consisting of selenium alone. Curve 15 shows that of a selenium-sulfur alloy having a sulfur content of 10%. Curve 16 shows that of an Se-S alloy wherein S=25%. It will be understood that the curve shifts toward the shorter wavelength side as the sulfur content increases. Electromagnetic rays of an energy lower than 2.1 eV will pass through the Se-S alloy when S=20% substantially with no abosrption. Thus, the alloy will have no sensitivity to an electromagnetic wavelength not less than 5800Å. Considering, however, that an Se-S alloy photoconductive layer has flexibility, and that in addition this layer advantageously allows a black-and-white copy to be produced, this layer can be used in practice only if the residual potential exhibited by the alloy is reduced. This reduction of the residual potential has been found to be achieved by the addition of halgen. Moreover, such addition of halogen has been found also to be effective for improving a fatigue property of the photoconductive structure of the present invention as will be described in detail layer. The results of various experiments conducted by the inventors show that the Se-S-Halogen layer should suitably have a sulfur content of about 10 to 35% by weight based on the Se-S alloy; that in case the content of sulfur is lower than the lower limit, no satifsactory flexibility if obtained; and that in case it is higher than the upper limit, the residual potential of the alloy is noted to be undesirably too high. It has been noted that the content of halogen should be in the range of about $10^{-2}$ to $10^{-7}$, and preferably about $10^{-3}$ to $10^{-5}$, in a weight ratio to Se-S. In case the halogen content is lower than the lower limit, no aimed effects are achieved, whereas if it is higher than the upper limit, the electroconductivity is augumented. The Se-S-Halogen layer is formed best with a thickness of about 10μ to 100μ, preferably about 20μ to 70μ.

Figure 4:
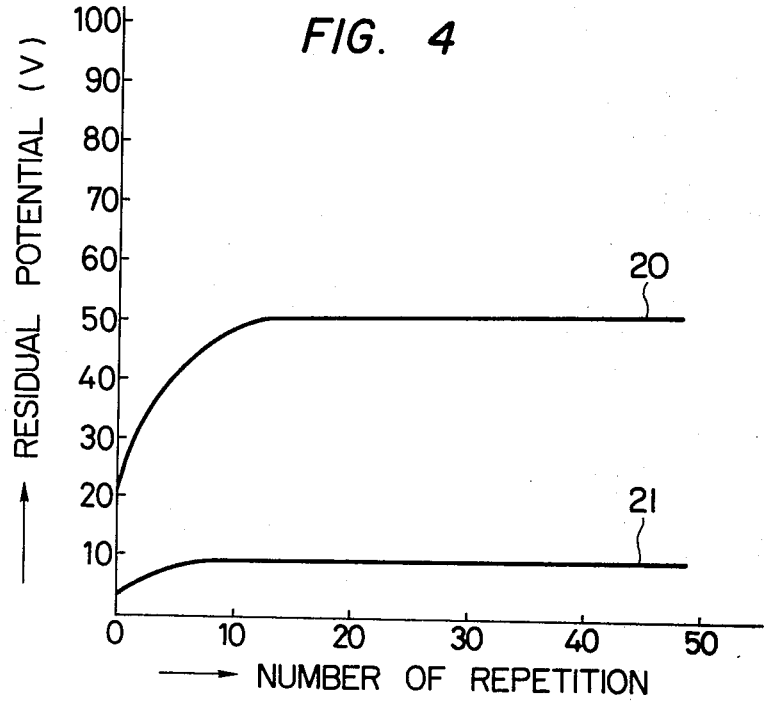
FIG. 4 is a chart showing variations of residual potential for repetition of charge-exposure cycle of photoreceptor of electrophotography containing an Se-S or an Se-S-Br photoconductive layer.

The photoconductive structure of the present invention has an Se-Te-Halogen layer formed on top of an Se-S-Halogen layer. As described above, a photo-receptor of electrophotography containing a photo-conductive layer of Te-doped selenium is known in the art. Tellurium is a metal in the same group as selenium, but in a position just one period later than selenium in the periodic table. It has been found that by doping tellurium in selenium, the alloy becomes sensitive to longer electromagnetic wavelengths, and responds more quickly to electromagnetic rays. However, the Se-Te alloy has the disadvantage that it has a high level of residual potential and that residual charges accumulate gradually during successive repetition of a printing cycle. This accumulation of residual charges results in an increase in the residual potential, bringing about degradation of contrast of the developed image, and also results in the formation of "fog". It has been found, however, that, by this addition of halogen to an Se-Te alloy, these disadvantages can be elminated. That is, by doing so, the residual potential can be lowered and yet the fatigue property can also be improved. This fact is shown in FIG. 4. More specifically, a photo-receptor of electrophotography having the structure shown in FIG. 1 containing the Se-Te-Halogen layer 13 is subjected to successive repetition of a cycle which consists of the step of charging the structure with electricity up to a potential of about 1000 V and a subsequent step of exposing the charged structure to light rays of 18.8 lux./sec. by the use of a tungsten lamp of 50 lux., and the structure is charged up immediately again after the exposure. A control experiment is also performed in a similar way, except that the layer 13 does not contain halogen. In both cases, variations of the residual potential at the end of the exposure to light rays of 18.8 lux./-sec. are illustrated as a function of the number of repetitions of the cycle. The results are shown in FIG. 4 wherein curve 20 is for the control structure and curve 21 is for the structure of the present invention. In order to lower the residual potential without a loss of sensitivity to red color, it is necessary to carefully select both the tellurium content and halogen content so as to be of appropriate amounts. That is, tellurium is added in an amount of 0.05 to 0.35 in a weight ratio to the Se-Te alloy. If the tellurium content is lower than the lower limit, the effect obtained is insufficient, whereas if it is higher than the upper limit, the discharge or decay in darkness will increase. The halogen content is in a weight ratio of $10^{-3}$ to $10^{-8}$, preferably $10^{-3}$ to to $10^{-6}$, and most preferably $10^{-3}$ to $10^{-5}$, to the halogen-containing Se-Te alloy. If the halogen content is lower than the lower limit, desired effects cannot be obtained sufficiently, whereas if it is higher than the upper limit, the Se-Te-Halogen layer tends to crystallize. Even in amorphous form, the optical sinsitivity of this layer will not extend so far as to red color. The Se-Te-Halogen layer suitably has a thickness of about 0.1μ to 10μ.

As stated above, the photoreceptor of electrophotography of the present invention has an Se-S-Halogen layer formed on top of a substrate, and an Se-Te-Halogen layer is formed on top of said Se-S-Halogen layer. As the substrate, any one of materials such as a metal including aluminum and steel, or a metalized paper, or plastics or like materials which have been used heretofore as such substrate may be used. The halogen which is used in the present invention, may be at least one halogen selected from a group consisting of fluorine, bromine, chlorine and iodine. The above-mentioned contents of sulfur, tellurium and halogen are all based on the composition of the source alloy prepared for the vacuum evaporation technique.

Figure 3:
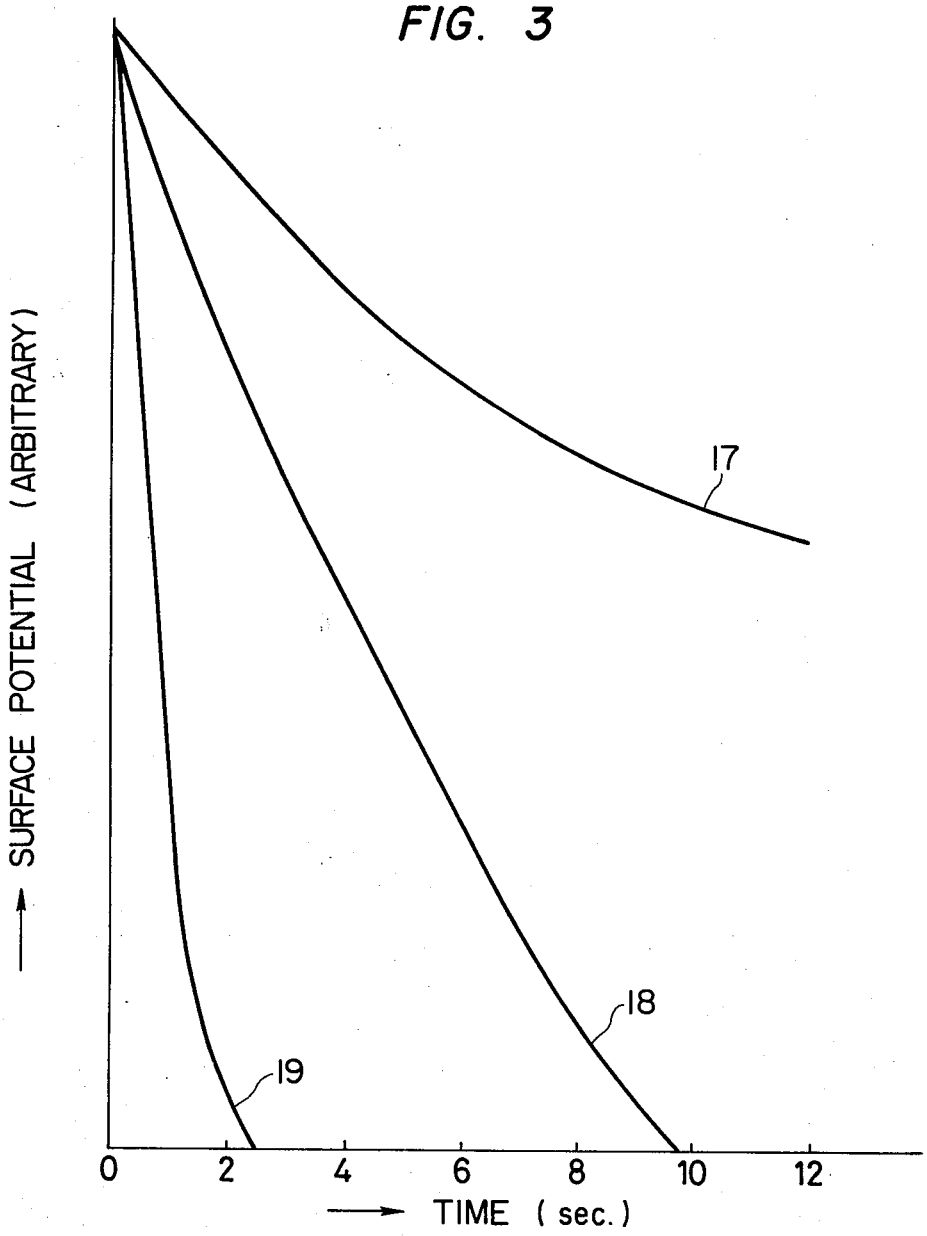
FIG. 3 is a chart showing photo-decay properties, upon exposure to light rays, of electrophotographic plates containing an Se-S photoconductive layer or an Se-S-Br photoconductive layer, and of a multi-layer photoreceptor of electrophotography of the present invention.

FIG. 3 shows a comparative profile of the photo-decay of potential with time upon exposure to light rays obtained by using a photoreceptor of electrophotography of the present invention versus control plates. In the Figure, curve 17 indicates the profile exhibited by a plate having an $Se\text{-}S_{0.2}$ layer formed on an aluminum substrate, curve 18 indicates a profile exhibited by a plate having an $Se\text{-}S_{0.2}\text{-}Br_{10}-4$ layer formed on an aluminum substrate, and curve 19 indicates a profile exhibited by a plate having an $Se\text{-}Te_{0.07}\text{-}Br_{10}-5$ top layer formed on top of an $Se\text{-}S_{0.2}\text{-}Br_{10}-4$ intermediate layer formed on an aluminum substrate, according to the present invention. The light source employed is a tungsten lamp of 50 lux. having 2800° K. It will be understood from FIG. 3 that the multi-layer photoconductive structure of the present invention shows a superior photo-decay characteristic as compared with such characteristics of the photoconductive layers of the Se-S and the Se-S-Br control alloys.

The present invention will hereunder be explained further with reference to the examples.

EXAMPLE I 80 gr. of selenium having a purity of 99.999% are melted in a casserole at 350° C., and then 20 gr. of sulfur having a purity of 99.999% are added to the melt. After selenium and sulfur have been sufficiently mixed together by stirring the melt, the resulting melt is poured into a stainless butt which has been cooled in advance. After the contents are cooled, the contents are pulverized to produce a powdery Se-S alloy which will be refered to hereinafter as a master batch A. Bromine having a purity of 99.99% is introduced dropwise into selenium powder having a purity of 99.999%, followed by stirring. The resulting $SeBr_4$ which is thus obtained is mixed with a master batch A which is metered so that the weight ratio of the bromine content in the $SeBr_4$ to the Se-S mixture is $2\times10^{-4}$, and the resulting mixture is pulverized to produce a powdery Se-S-Br mixture which will hereunder be referred to as a master batch B. Separately, 93 gr. of selenium having a purity of 99.999% are melted by heat in a casserole at 350° C., and 7 gr. of tellurium having a purity of 99.999% are added to this melt and stirred. Then, this casserole is heated up to 450° C. and is poured into a stainless butt which has been cooled in advance. The resulting cooled mixture is pulverized to produce a powdery Se-Te alloy which will hereinafter be referred to as a master batch C. A portion of the master batch C is further pulverized to an average particle size of about 10μ, and bromine having a purity of 99.99% is introduced dropwise into this powder while stirring to produce a $(SeTe)Br_4$ mixture. This mixture is further mixed with the master batch C at a weight ratio of the bromine content to the SeTe of $1\times10^{-5}$, and the resulting mixture is pulverized to produce a powdery Se-Te-Br alloy which will hereunder be referred to as a master batch D.

Figure 5:
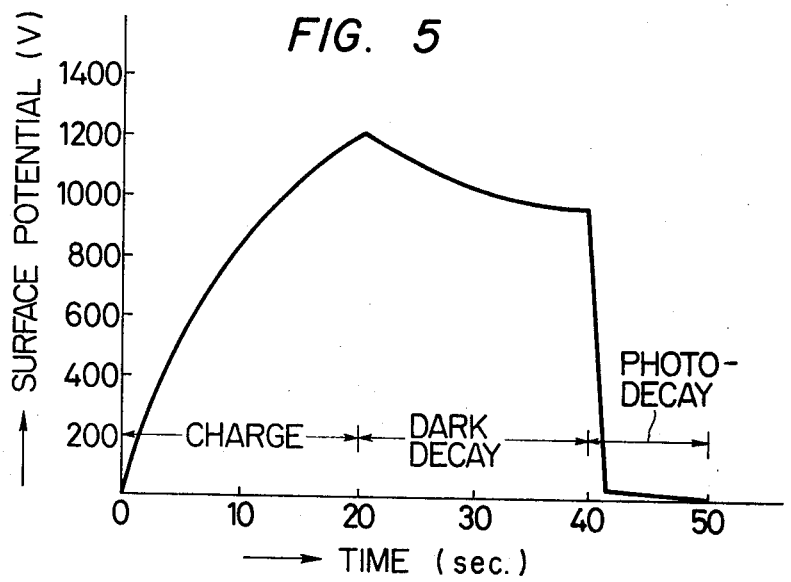
FIG. 5 is a chart showing electrostatic properties of a multi-layer photoreceptor of electrophotography according to the present invention.
Figure 6:
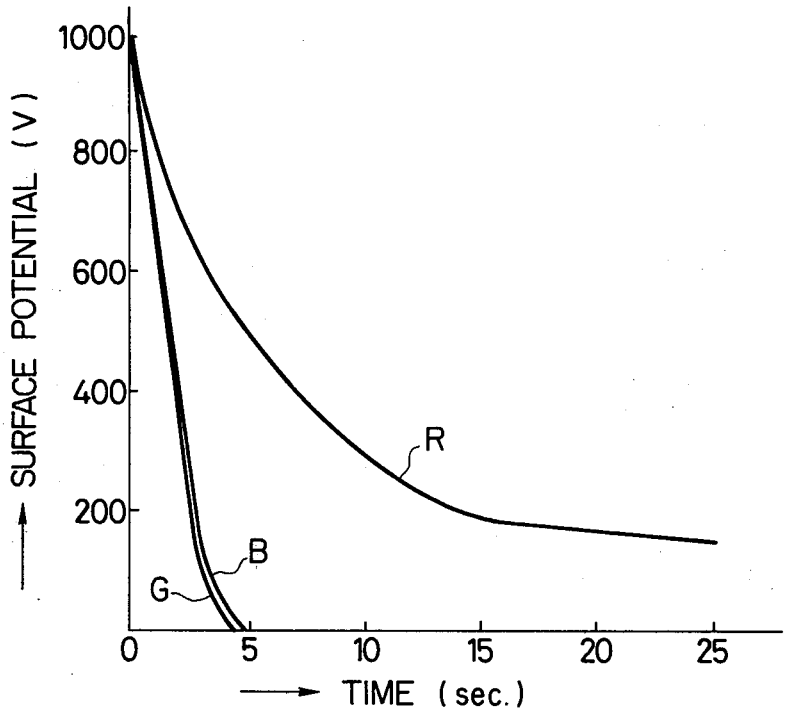
FIG. 6 is a chart showing the photo-decay property of a multi-layer photoreceptor of electrophotography of the present invention, upon exposure to light rays, with changes in color.

A surface-polished aluminum plate of 0.4 mm (thickness)×50 mm×100 mm serving as a substrate is mounted on a substrate support provided in a chamber of a vacuum-evaporation apparatus, with a mirror surface facing downward. This substrate support is provided with means for controlling the temperature of the substrate by circulation of flow of temperature-controlled water. Under the support, there are provided two stainless boats which are connected to a power source for heating these boats. A partition plate having two shutters is provided between the support and the boats. 15 gr. of the master batch B are placed into one (first one) of these two stainless boats, and 2.5 gr. of the master batch D are placed into the other one (second one) of the boats. The distance from the aluminum plate to each boat is about 20 cm. This vacuum-evaporation chamber is evacuated up to a pressure of about $5\times10^{-5}$ Torr, and the substrate is held at about 72° C. The first boat containing the master batch B is heated at 310° C., and then the shutter is opened for 30 minutes to perform vacuum-evaporation deposition of the Se-S-Br alloy layer onto the mirror surface of the substrate. Thereafter, the shutter for the second boat containing the master batch D is opened and heated at 500° C. so as to perform vacuum-evaporation deposition of the Se-Te-Br alloy film onto the Se-S-Br alloy layer. Then, the shutters are closed, and the electric current for heating the boats is turned off to cool the substrate. The vacuum is broken, and the photoreceptor of electrophotography having the photconductive layers formed on the aluminum substrate is removed from the chamber. At the end of 24 hours during which the photoreceptor was kept in darkness, the photoreceptor is fixed to a rotating cylindrical drum, and the electrostatic properties of this photoreceptor are determined. The electric current for corona discharging is +30 μA, and the light source for the exposure of the drum is a tungsten lamp of 50 lux. having 2800° K. The results are shown in FIGS. 5 and 6. In FIG. 6, curve R represents a profile of photo-decay of the residual potential upon exposure to light rays coming after passing through a red color-transmitting filter Model V-059 which is placed in front of the aforementioned tungsten lamp. Curve G shows such photo-decay profile obtained by using a green color-transmitting filter Model S-GI instead of the filter Model V-059, and Curve B shows a profile in case a blue color-transmitting filter Model V-CIB is used. These Models V-059, S-GI and V-CIB are sold by Toshiba Kasei Kogyo, Ltd. of Japan. The initial retained potential before photo-decay due to exposure is 1000 V.

EXAMPLE II

The procedure of Example I is repeated, excepting that $SeBr_4$ and $(SeTe)Br_4$ are replaced by $SeCl_4$ and $(SeTe)Cl_4$, respectively. $SeCl_4$ is produced by passing Cl gas having a purity of 99.999% through an amount of powdery selenium having a purity of 99.999%. $(SeTe)Cl_4$ is produced by passing Cl gas having a purity of 99.999% through an amount of the powdery master batch C. By using these alloys, photoreceptors of electrophotography are produced in the same way as that for Example I. These photoreceptors exhibit almost the same electrostatic and mechanical properties as those in Example I.

EXAMPLE III

The procedure of Example I is followed, excepting that $SeI_4$ and $(SeTe)I_4$ are employed instead of $SeBr_4$ and $(SeTe)Br_4$, respectively. $SeI_4$ is produced by a procedure similar to that for $SeBr_4$, using iodine having a purity of 99.99%. $(SeTe)I_4$ is produced by a procedure similar to that for the production of $(SeTe)Br_4$ in Example I, using the powdery master batch C, and using iodine having a purity of 99.99%. Instead of the master batch B, a mixture of iodine and SeS alloy in a weight ratio of iodine to SeS of $1\times10^{-3}$ is used, and instead of the master batch D, a mixture of iodine and SeTe alloy in an iodine to SeTe weight ratio of $5\times10^{-5}$ is used. The vacuum-evaporation deposition is carried out in a way similar to that in Example I. The photoreceptors of electrophotography thus obtained show almost the same electrostatic and mechanical properties as those noted in Example I.

EXAMPLE IV

Similar to Example I, an amount of $SeBr_4$ mixture is added to an amount of the master batch A which is being melted at 350° C. The weight ratio of the former to the latter is such that a ratio of bromine content in the former to SeS alloy by weight is set at $2\times10^{-3}$. The melt is stirred, and then poured into a stainless butt which has been cooled beforehand. The resulting cooled mixture is pulvertized, and it is employed instead of the master batch B in Example I. Apart from it, an amount of $(SeTe)Br_4$ is added to an amount of the master batch C which is being melted at 350° C. The weight ratio of the former to the latter is such that a ratio of bromine content in the former to SeTe alloy is $1\times10^{-4}$ by weight. The melt is stirred, and then poured into a stainless butt which has been cooled in advance. The cooled mixture is pulverized, and is employed in place of the master batch D in Example I. The vacuum-evaporation deposition is performed in a way similar to that in Example I. The resultant photoreceptor of electrophotography exhibits almost the same properties as those noted in Example I.

EXAMPLE V

The procedures of Examples I to IV are followed, excepting that the aluminum substrate is replaced by an aluminum foil of 50μ in thickness. The resultant photoreceptors of electrophotography also show almost the same properties as those observed in Example I. Then, the photoreceptors are employed in a dray type copying machine model PPC 900 sold by Richo Co. Ltd. of Japan to perform reproduction. The reproduced images have a higher quality with respect to contrast, i.e. a contrast close to that of the original pattern, over a wide range of the light-ray spectrum, using a smaller amount of light rays as compared with ordinary photoreceptor plates carrying a vacuum-deposited phtoconductive layer of slenium or SeTe alloy. Even after successive repeated reproductions, almost same high quality images as those initially produced are obtained. Moreover, the photoreceptors of the present invention are applied around a cylinder of 20 mm in radius. No. disorder is observed.

The above-mentioned examples illustrate some aspects of the present invention, and the present invention is not intended to be limited to these procedures. It will be understood clearly from these examples that sulfur-doped selenium as well as halogen-doped selenium do not produce a satisfactory photoconductive layer, and that the coexistence of sulfur and halogen in an appropriate concentration in selenium is required for the production of a desirable practical photoreceptor of electrophotography having a sufficient flexibility and exhibiting a lower residual potential. It will be appreciated also that, in order to prevent an increase in residual potential during repetition of copying cycle without the accompaniment of a substantial loss of sensitivity to red color, coexistence of tellurium and halogen in an appropriate concentration in selenium is required, instead of the employment of tellurium alone. From the foregoing description, the advantages of the photoconductive structure according to the present invention which has an Se-Te-Halogen layer formed on an Se-S-Halogen layer are apparent. Although an aluminum plate and an aluminum foil are employed as substrates in the above examples, the present invention is not limited thereto. For example, metalized or electroconductivity-imparted resinous films or other metallic substrates may be used, so long as they are inert to Se, S and halogen and have a resistivity lower than that exhibited by Se-S-Halogen layer under illumination.

What is claimed is:

1. A photoreceptor for electrophotography comprising:

(1) a first layer of a Se-Te-Halogen alloy containing halogen in a weight ratio of $10^{-3}$ to $10^{-8}$ to the Se-Te-Halogen alloy and a Te content of about 5 to about 35% by weight of the Se-Te alloy, the thickness of said first layer being about 0.1 to 10 microns, said first layer formed on top of, (2) a second layer of an Se-S-Halogen alloy containing halogen in a weight ratio of $10^{-2}$ to $10^{-7}$ to the Se-S-Halogen alloy and having a sulfur content of about 10 to about 35% by weight based on the Se-S alloy, the thickness of said second layer being about 10 to about 100 microns, said second layer formed on top of an electrically conductive substrate.

2. The photoreceptor for electrophotography according to claim 1, wherein: said Se-S-Halogen layer has a thickness of about 20 to 70 microns.

3. The photoreceptor for electrophotography according to claim 1, wherein: halogen in said Se-S-Halogen layer is at least one halogen selected from a group consisting of fluorine, chlorine, bromine and iodine.

4. The photoreceptor for electrophotography according to claim 1, wherein: said Se-S-Halogen layer contains at least one halogen selected from a group consisting of chlorine, bromine and iodine in a weight ratio of $10^{-3}$ to $10^{-5}$ to the Se-S-Halogen alloy.

5. The photoreceptor for electrophotography according to claim 1, wherein: halogen in said Se-Te-Halogen layer is at least one halogen selected from a group consisting of chlorine, bromine and iodine.

6. The photoreceptor for electrophotography according to claim 1, wherein: said Se-Te-Halogen layer contains at least one halogen selected from a group consisting of chlorine, bromine and iodine in a weight ratio of $10^{-3}$ to $10^{-5}$ to the Se-Te-Halogen alloy.

* * * * *